US005741128A

United States Patent [19]

Tsai

[11] Patent Number: 5,741,128

[45] Date of Patent: Apr. 21, 1998

[54] HAND GAS TORCH

[76] Inventor: Chin-Lin Tsai, 3F, No. 94, Sec. 4, Chung Hsin Road, San Chung City, Taipei Hsien, Taiwan

[21] Appl. No.: 909,632

[22] Filed: Aug. 21, 1997

[51] Int. Cl.[6] ..... F23Q 7/12

[52] U.S. Cl. ..... 431/255; 431/344; 126/407; 126/413

[58] Field of Search ..... 431/255, 344, 431/345, 266, 247, 265, 354; 126/401, 407, 413, 406, 414, 405

[56] References Cited

U.S. PATENT DOCUMENTS

| | | | |
|---|---|---|---|
| 3,597,732 | 8/1971 | Yoshinaga | 431/255 |
| 4,804,324 | 2/1989 | Yoshinaga | 431/344 |
| 5,505,614 | 4/1996 | Lin | 431/143 |
| 5,531,592 | 7/1996 | Tsai | 431/344 |
| 5,564,919 | 10/1996 | Tsai | 431/255 |
| 5,573,393 | 11/1996 | Tsai | 431/255 |
| 5,647,738 | 7/1997 | Tsai | 431/344 |

*Primary Examiner*—James C. Yeung
*Attorney, Agent, or Firm*—Bacon & Thomas

[57] ABSTRACT

A hand gas torch which includes a fuel gas tank having a gas outlet, gas flow rate control valve assembly mounted in the gas outlet of the fuel gas tank and controlled by a gas lever to open a fuel gas passage, a casing fastened to the fuel gas tank around the gas outlet, a flame nozzle assembly fastened to the casing at which fuel gas and air mixture is burned, a fuel gas nozzle assembly connected between the flame nozzle assembly and the gas flow rate control valve assembly, a piezoelectric device mounted in the casing and controlled to produce sparks at the flame nozzle assembly for burning fuel gas and air mixture, a press button depressed to trigger the piezoelectric device and to drive the gas lever in opening the gas flow rate control valve assembly, a rotary cap controlled to lock/unlock the press button, and a switch controlled to hold the gas flow rate control valve assembly in an open status.

9 Claims, 5 Drawing Sheets

HAND GAS TORCH

BACKGROUND OF THE INVENTION

The present invention relates to hand gas torches, and more particularly to such a hand gas torch which comprises a rotary cap turned to lock/unlock a press button, which is adapted for triggering a piezoelectric device in producing sparks and driving a gas lever in opening a gas flow rate control valve assembly, and a switch controlled to hold the gas flow rate control valve assembly in an open status for permitting fuel gas to continuously flow to a flame nozzle for burning.

Regular gas lighters are commonly used for making fire for burning cigarette, incense, etc. However, these gas lighters are not suitable for use in heating or welding things because of limited fire power. If to keep fuel gas continuously flowing out of the gas lighter for burning, the gas lever must be maintained depressed. Further, when the gas lever is maintained depressed for a certain length of time after a flame is produced, the casing of the gas lighter becomes to hot to be held in hand.

SUMMARY OF THE INVENTION

The present invention has been accomplished under the circumstances in view. According to the preferred embodiment of the present invention, the hand gas torch comprises a fuel gas tank having a gas outlet and an upright mounting rod a top side thereof and a bottom side sealed with a bottom cover, the bottom cover having a valve block at the center and a feed valve mounted in the valve block through which fuel gas is filled into the fuel gas tank; a gas flow rate control valve assembly mounted in the gas outlet of the fuel gas tank and controlled to regulate the flow rate of fuel gas passing out of the fuel gas tank through its gas outlet;

a gas lever coupled to the upright mounting rod of the fuel gas tank and controlled to open the gas flow rate control valve assembly for permitting fuel gas to flow out of the gas outlet of the fuel gas tank; a casing made by fastening two symmetrical half shells together and fastened to the fuel gas tank and covered over the gas flow rate control valve assembly, the casing comprising a tubular front end, an elongated switch hole at one side, an igniter holder extended from a rear side thereof and defining a receiving chamber, an opening at the igniter holder in communication with the receiving chamber, and two sliding grooves symmetrically disposed inside the igniter holder around the receiving chamber; a flame nozzle assembly fastened to the tubular front end of the casing, the flame nozzle assembly comprising an outer tube fixedly fastened to the tubular front end of the casing, a heat insulative inner tube mounted within the outer tube,, and a flame nozzle mounted in the heat insulative inner tube and connected to the gas flow rate control valve assembly to receive fuel gas from it, the flame nozzle having a radial air vent through which outside air is induced into the inside of the flame nozzle to mix with fuel gas for burning; a fuel gas nozzle assembly connected between the flame nozzle assembly and the gas flow rate control valve assembly, the fuel gas nozzle assembly comprising a gas nozzle connected to the flame nozzle assembly, and a flexible gas tube having a bottom end connected to the gas flow rate control valve assembly and a top end connected to the gas nozzle; a piezoelectric igniter unit mounted in the casing, the piezoelectric igniter unit comprising a piezoelectric device mounted in the receiving chamber of the igniter holder of the casing and controlled to produce sparks at the flame nozzle for igniting fuel gas, a press button controlled to trigger the piezoelectric device and to drive the gas lever in opening the gas flow rate control valve assembly, and a rotary cap fastened to the igniter holder of the casing and turned relative to the igniter holder of the casing to lock/unlock the press button, the press button comprising a downward pressure rod stopped above the gas lever, and a stop flange raised from the periphery, the rotary cap comprising two inside ribs respectively coupled to the inside sliding grooves of the igniter holder of the casing, and a stop flange moved with the rotary cap in the opening of the igniter holder of the casing between a first position in which the stop flange of the rotary cap is forced into engagement with the stop flange of the press button to stop the press button from downward movement, and a second position in which the stop flange of the rotary cap is disengaged from the stop flange of the press button for permitting the press button to be depressed; and switch means mounted in the elongated switch hole of the casing and moved between a first position in which the gas lever is turned upwards to hold the gas flow rate control valve assembly in an open status for permitting fuel gas to continuously flow out of the fuel gas tank into the flame nozzle assembly, and a second position in which the gas lever is disengaged from the switch means and can be operated by the press button.

DETAILED DESCRIPTION OF THE PREFERRED EMBODIMENT

Figure 1:
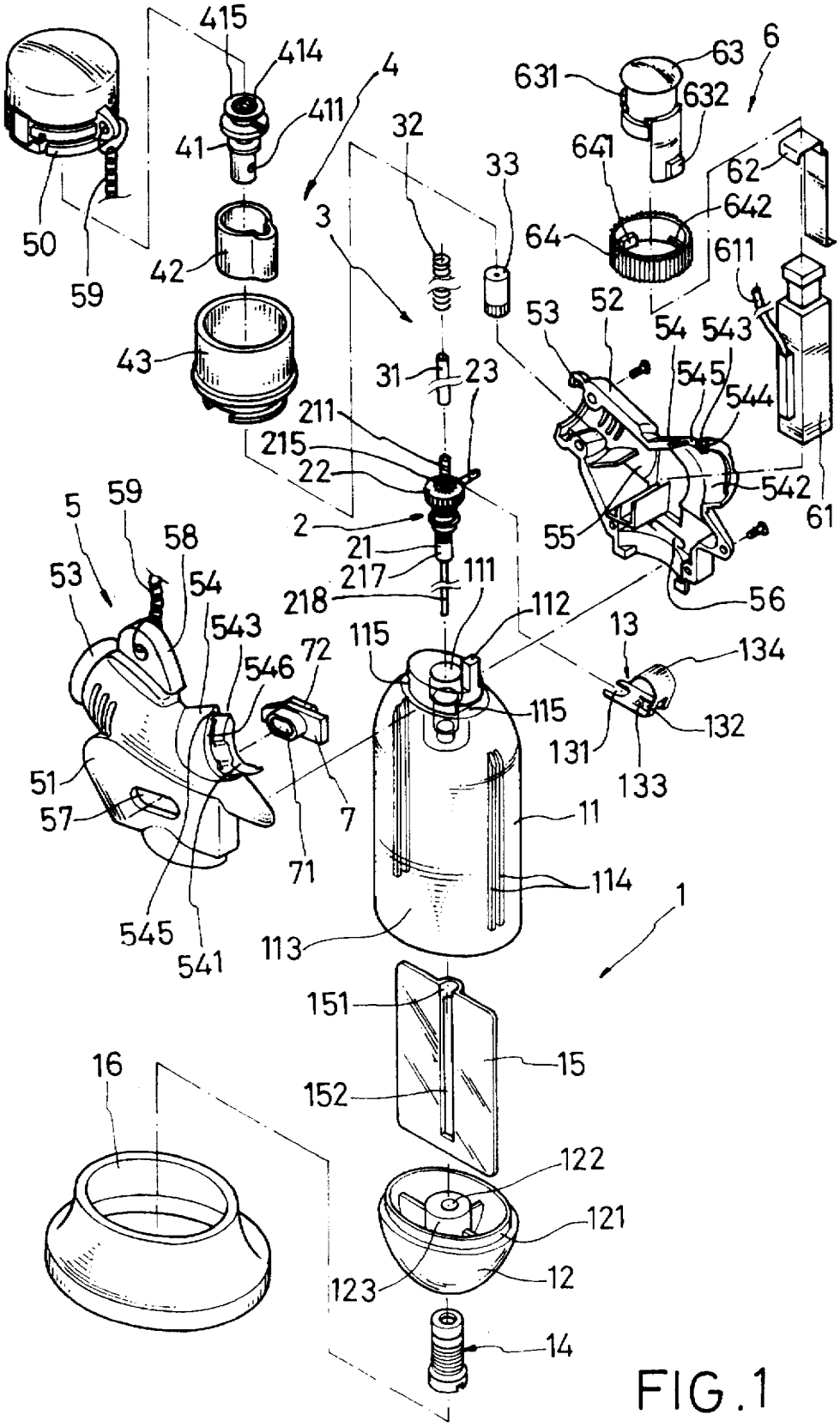
FIG. 1 is an exploded view of a hand gas torch according to the present invention.

Referring to FIGS. from 1 to 6, a hand gas torch in accordance with the present invention is generally comprised of a fuel tank unit 1, a gas flow rate control valve assembly 2, a fuel gas nozzle assembly 3, a flame nozzle assembly 4, a casing 5, a piezoelectric igniter unit 6, and a switch 7.

Figure 4:
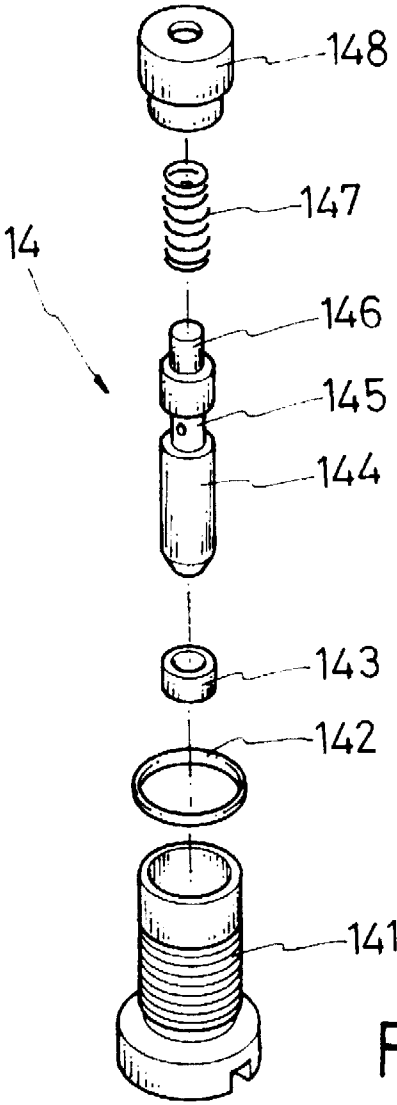
FIG. 4 is an exploded view of the feed valve of the hand gas torch shown in FIG. 1.

The fuel tank unit 1 comprises a fuel gas tank 11 defining a fuel gas chamber 113, a bottom cover 12 covered on the fuel gas tank 11 at its bottom side. The fuel gas tank 11 comprises a gas outlet 111 at its top side which receives the gas flow rate control valve 2, an upright mounting rod 112 adjacent the gas outlet 111, and a gas lever 13 mounted on the upright mounting rod 112. The gas lever 13 comprises a U-notch 131 at one end, a mounting slot 132 in the middle coupled to the upright mounting rod 112, a downwardly forwardly extended pressure rod 133 raised from one side of the mounting slot 132 and pressed on the gas flow rate control valve 2, and an upwardly forwardly extended press rod 134 at an opposite end. The bottom cover 12 comprises a top rim 121, an upright valve seat 123 raised from the inside at the center and defining a fuel gas passage 122, and a feed valve 14 fastened to the fuel gas passage 122 of the upright valve seat 123. When the fuel gas nozzle of a commercially available gas can is pressed on the feed valve 14, fuel gas is charged into the fuel gas chamber 113 of the fuel gas tank 11. The feed valve 14, as shown in FIG. 4, comprises a threaded valve block 141, a first rubber seal ring 142 mounted around the threaded valve block 141, a valve rod 144 mounted within the threaded valve block 141 and having a head 146 at its top end and a neck 14 in the middle, a second rubber seal ring 143 mounted around the neck 14 of the valve rod 144, a cap 148 fixedly fastened to the threaded valve block 141, and a spring 147 mounted within the cap 148 around the head 146 of the valve rod 144. The spring 147 imparts a downward pressure to the valve rod 144, causing it to close the passage of the feed valve 14.

Further, the fuel gas tank 11 has two longitudinal pairs of rails 114 bilaterally disposed inside its fuel gas chamber 113, and an ornamental display board 15 is fastened to the rails 114 inside the fuel gas chamber 113. The display board 15 is printed with commercial words, having a longitudinal fuel gas guide groove 151 in the middle and an opening 152 in the longitudinal fuel gas guide groove 151. Of course, the fuel gas tank 11 must be made transparent so that the commercial words of the display board 15 can be seen from the outside.

Figure 3:
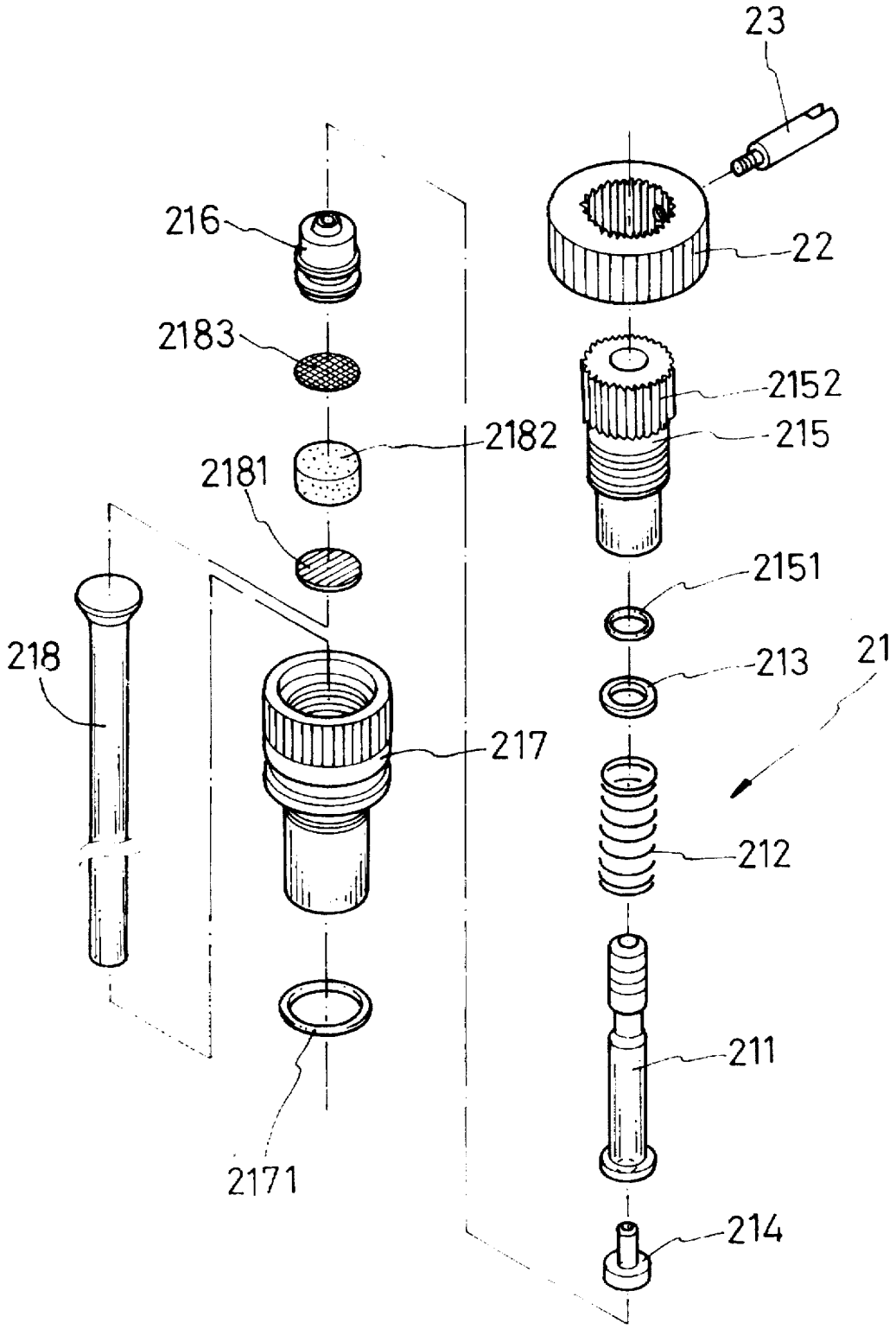
FIG. 3 is an exploded view of the gas flow rate control valve assembly of the hand gas torch shown in FIG. 1.

The gas flow rate control valve assembly 2 is comprised of a control valve 21 mounted in the gas outlet 111 of the fuel gas tank 11, an adjustment ring 22 mounted around the control valve 21, and an adjustment lever 23 connected to the adjustment ring 22 and turned to control the flow rate of fuel gas passing through the control valve 21. As illustrated in FIG. 3, the control valve 21 comprises a stepped socket 217 mounted in the gas outlet 111 of the fuel gas tank 11, a first rubber seal ring 2171 mounted around the stepped socket 217 within the gas outlet 111, a dip tube 218 mounted in the stepped socket 217 and extended out of its bottom end and dipped in liquid fuel gas in the fuel gas tank 11, a valve block 215 fastened to the socket 217 on the inside by a screw joint and having a toothed head 2152 fastened to the adjustment ring 22, a hollow valve rod 211 mounted inside the valve block 215 and partially projecting out of its top end and coupled to the U-notch 131 of the gas lever 13, a spring 212 mounted within the valve block 215 around the valve rod 211, a cushion 2151 mounted within the valve block 215 around the valve rod 211 and supported on the spring 212, a substantially T-shaped hollow cap 214 mounted in the hollow valve rod 211 at its bottom end, a hollow plug member 216 plugged in the bottom end of the valve block 215 below the cap 214 inside the socket 217, a copper plate 2181 and a copper wire gauze filter 2183 mounted in the top end of the dip tube 218 within the stepped socket 217, and a sponge 2182 mounted within the stepped socket 217 and retained between the copper plate 2181 and the copper wire gauze filter 2183. When the valve rod 211 is moved upwards, the T-shaped cap 214 is disengaged from the plug member 216 for permitting fuel gas to flow through the valve rod 211 into the fuel gas nozzle assembly 3. On the contrary, when the valve rod 211 is lowered, the cap 214 is forced downwards to close the plug member 216, and therefore fuel gas is stopped from passing to the fuel gas nozzle assembly 3. Further, when the adjustment ring 22 is turned by the adjustment lever 23, the valve block 215 is turned relative to the stepped socket 217, and the compressive force to the sponge 2182 is relatively adjusted, and therefore the flow rate of fuel gas is relatively controlled.

The fuel gas nozzle assembly 3, as shown in FIG. 1, comprises a gas nozzle 33 connected to the flame nozzle assembly 4, a flexible gas tube 31 having a bottom end connected to the valve rod 211 of the control valve 21 and a top end connected to the gas nozzle 33, and a metal coil spring 32 mounted around the flexible gas tube 31.

Figure 5:
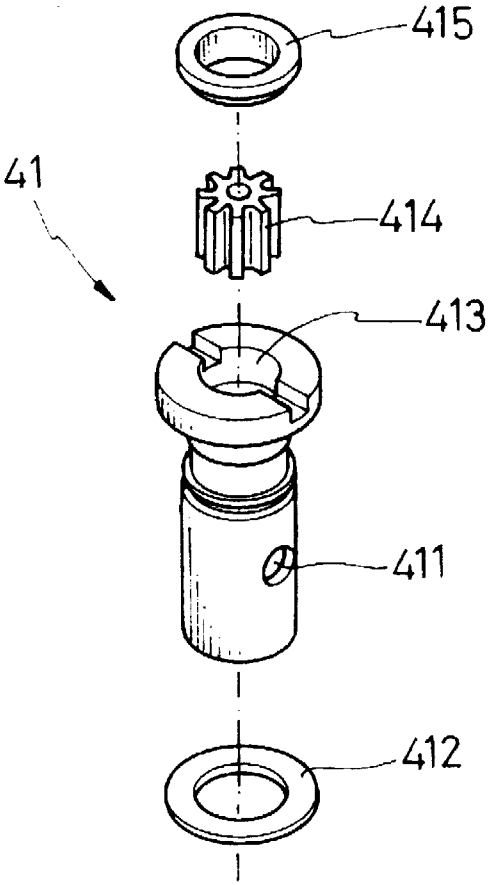
FIG. 5 is an exploded view of a part of the flame nozzle assembly of the hand gas torch shown in FIG. 1.

The flame nozzle assembly 4, as shown in FIG. 1 and 5, comprises an outer tube 43 fastened to the casing 5 at its front end, a heat insulative inner tube 42 mounted within the outer tube 43, and a flame nozzle 41 mounted within the heat insulative inner tube 42 and having an axial nozzle hole 413 connected to the gas nozzle 33 and a radial air vent 411 adapted to guide outside air into the axial nozzle hole 413 for mixing with fuel gas for combustion, a gear 414 mounted within the axial nozzle hole 413 and adapted to guide out fuel gas through its center through hole and axial periphery grooves, a hollow cap 415 mounted on the flame nozzle 41 to hold the gear 414 in place, and a gasket 412 mounted around the flame nozzle 41 and supported on the heat insulative inner tube 42.

Figure 6:
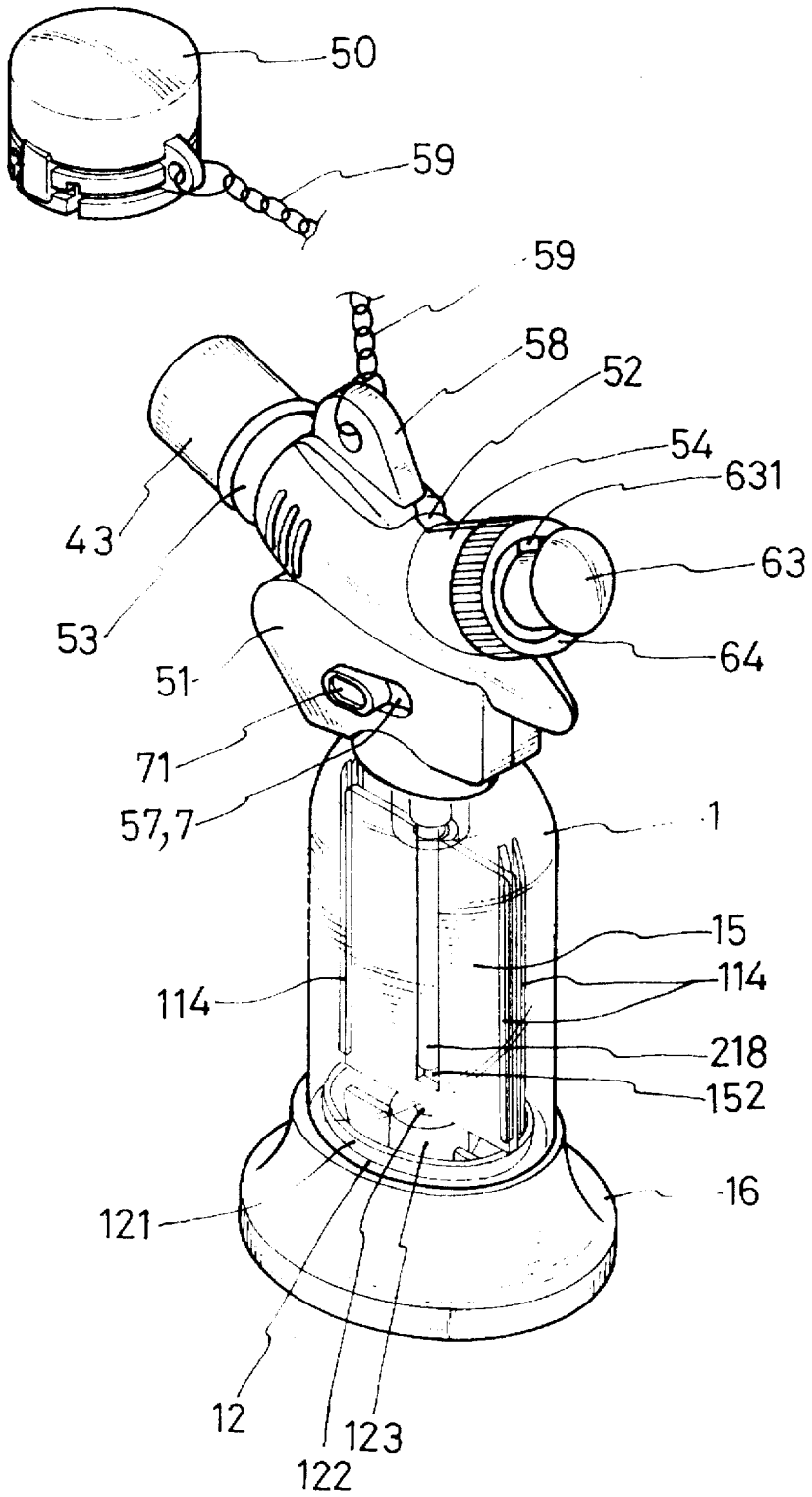
FIG. 6 is an elevational view of the hand gas torch according to the present invention.

Referring to FIGS. 1 and 6, the casing 5 is comprised of a left shell 51 and a right shell 52 fastened together and secured to a top mounting groove 115 of the fuel gas tank 11 around the flame nozzle assembly 4, the fuel gas nozzle assembly 3 and the gas flow rate control valve assembly 2. The tubular front end 53 of the casing 5 is fastened to the periphery of the outer tube 43 of the flame nozzle assembly 4. The shells 51;52 have a respective rear extension portion 541;542 abutted together. The rear extension portions 541;542 of the shells 51;52 form an igniter holder 54 defining a receiving chamber 55 adapted to receive the piezoelectric igniter unit 6. The rear extension portions 541;542 have a respective notch 543, a respective stop edge 545 below the respective notch 543, and a respective sliding groove 546. The rear extension portion 542 of the right shell 52 further has a slot 544 extended from its notch 43. The left shell 51 further comprises an elongated switch hole 57 for the mounting of the switch 7, and a lug 58 to which a nozzle cap 50 is connected by a chain 59. The nozzle cap 50 can be covered on the outer tube 43 of the flame nozzle assembly 4 when the hand gas torch is not in use.

Referring to FIGS. 1 and 6 again, the piezoelectric igniter unit 6 comprises a piezoelectric device 61 mounted within the receiving chamber 55 of the casing 5 and having an electric wire 611 connected to the flame nozzle 41, a metal contact plate 62 connected to the piezoelectric device 61; a press button 63 supported on the piezoelectric device 61, the press button 63 having a stop flange 631 raised from its periphery and a downward pressure rod 632 stopped at the press rod 134 of the gas lever 13, and a rotary cap 64 mounted on the igniter holder 54 of the casing 5 to hold the press button 63 in place, the rotary cap 64 having two symmetrical inside ribs 642 respectively coupled to the sliding grooves 546 of the rear extension portions 541;542 of the shells 51;52 and a inside stop flange 641. When the rotary cap 64 is turned in one direction, the stop flange 641 of the rotary cap 64 is stopped below the stop flange 631 of the press button 63, and the press button 63 is locked. On the contrary, when the rotary cap 64 is turned in the reversed direction to move its stop flange 631 into the slot 544 of the rear extension portion 542 of the right shell 52, the press button 63 is unlocked and can be operated. When the press button 63 is unlocked and depressed, the metal contact plate 62 is forced into contact with the metal coil spring 32 to close the circuit of the piezoelectric igniter unit 6, causing the piezoelectric igniter unit 6 to produce sparks at the flame nozzle 41, and the gas lever 13 is forced to lift the valve rod 211 for permitting fuel gas to flow out of the fuel gas flow rate control valve 2 into the fuel gas nozzle assembly 3 and the flame nozzle assembly 4 for burning.

Referring to FIGS. 1 and 6 again, the switch 7 comprises a switch lever 71 extending out of the switch hole 57 of the left shell 51 of the casing 5, and a rear wing 72. The switch 7 is moved between two positions, namely, the operative position in which the rear wing 72 is forced in between the adjustment ring 22 and the U-notch 131 of the gas lever 13 to hold the front end of the gas lever 13 and the valve rod 211 in the lifted position for permitting fuel gas to be continuously guided out of the fuel gas tank 11 into the gas flow rate control valve assembly 2 and the fuel gas nozzle assembly 3, and the non-operative position in which the rear wing 72 is disengaged from the gas lever 13 and the valve rod 211 is lowered to stop fuel gas from escaping out of the fuel gas tank 11.

Referring to FIGS. 1 and 6 again, a foot member 16 is coupled to the bottom end of the fuel gas tank 11. By means of the foot member 16, the hand gas torch can be put on for example the top of a table.

Figure 2:
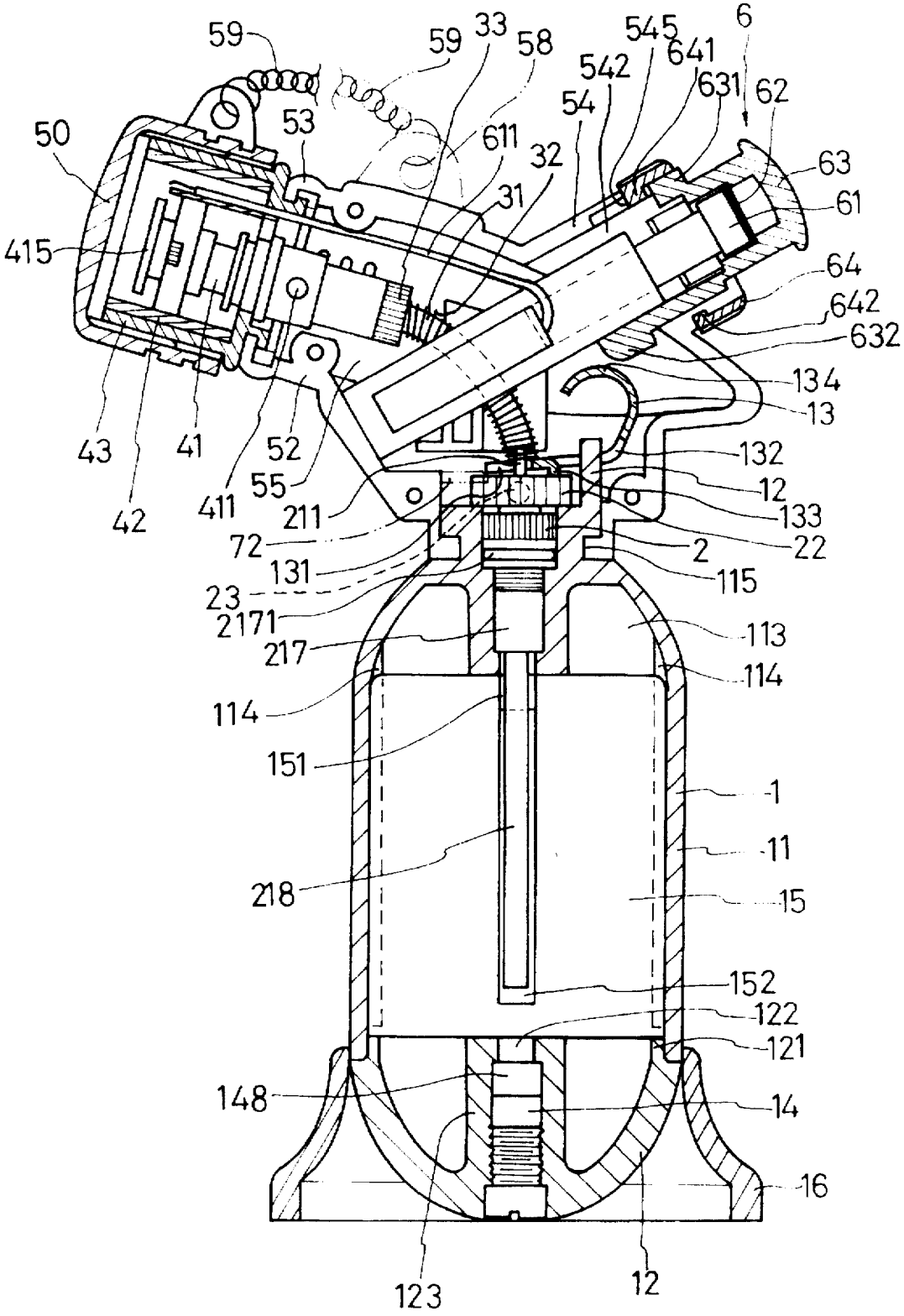
FIG. 2 is a sectional assembly view of the hand gas torch shown in FIG. 1.

Referring to FIGS. 1, 2 and 6 again, when in use, the rotary cap 64 is turned to unlock the press button 63, then the press button 63 is depressed to trigger the piezoelectric device 61, causing the piezoelectric device 61 to produce sparks at the flame nozzle 41, and simultaneously to drive the gas lever 13, causing the gas lever 13 to lift the valve rod 211 of the gas flow rate control valve assembly 2 for permitting fuel gas to flow out of the fuel gas tank 11 to the flame nozzle 41 for burning. When the press button 63 is released, the valve rod 211 is released and immediately returns to its former position to stop fuel gas, and therefore the flame is extinguished.

When to execute a continuous burning operation, the switch 7 is switched to the operative position to hold the valve rod 111 is the open position, for permitting fuel gas to be continuously supplied to the flame nozzle 41 for burning.

While only one embodiment of the present invention has been shown and described, it will be understood that various modifications and changes could be made thereunto without departing from the spirit and scope of the invention disclosed.

What the invention claimed is:

1. A hand gas torch comprising:

a fuel gas tank having a gas outlet and an upright mounting rod a top side thereof and a bottom side sealed with a bottom cover, said bottom cover having a valve block at the center and a feed valve mounted in said valve block through which fuel gas is filled into said fuel gas tank;

a gas flow rate control valve assembly mounted in the gas outlet of said fuel gas tank and controlled to regulate the flow rate of fuel gas passing out of said fuel gas tank through its gas outlet;

a gas lever coupled to the upright mounting rod of said fuel gas tank and controlled to open said gas flow rate control valve assembly for permitting fuel gas to flow out of the gas outlet of said fuel gas tank;

a casing made by fastening two symmetrical half shells together and fastened to said fuel gas tank and covered over said gas flow rate control valve assembly, said casing comprising a tubular front end, an elongated switch hole at one side, an igniter holder extended from a rear side thereof and defining a receiving chamber, an opening at said igniter holder in communication with said receiving chamber, and two sliding grooves symmetrically disposed inside said igniter holder around said receiving chamber;

a flame nozzle assembly fastened to the tubular front end of said casing, said flame nozzle assembly comprising an outer tube fixedly fastened to the tubular front end of said casing, a heat insulative inner tube mounted within said outer tube, and a flame nozzle mounted in said heat insulative inner tube and connected to said gas flow rate control valve assembly to receive fuel gas from it, said flame nozzle having a radial air vent through which outside air is induced into the inside of said flame nozzle to mix with fuel gas for burning;

a fuel gas nozzle assembly connected between said flame nozzle assembly and said gas flow rate control valve assembly, said fuel gas nozzle assembly comprising a gas nozzle connected to said flame nozzle assembly, and a flexible gas tube having a bottom end connected to said gas flow rate control valve assembly and a top end connected to said gas nozzle;

a piezoelectric igniter unit mounted in said casing, said piezoelectric igniter unit comprising a piezoelectric device mounted in the receiving chamber of the igniter holder of said casing and controlled to produce sparks at said flame nozzle for igniting fuel gas, a press button controlled to trigger said piezoelectric device and to drive said gas lever in opening said gas flow rate control valve assembly, and a rotary cap fastened to the igniter holder of said casing and turned relative to the igniter holder of said casing to lock/unlock said press button, said press button comprising a downward pressure rod stopped above said gas lever, and a stop flange raised from the periphery, said rotary cap comprising two inside ribs respectively coupled to the inside sliding grooves of the igniter holder of said casing, and a stop flange moved with said rotary cap in the opening of the igniter holder of said casing between a first position in which the stop flange of said rotary cap is forced into engagement with the stop flange of said press button to stop said press button from downward movement, and a second position in which the stop flange of said rotary cap is disengaged from the stop flange of said press button for permitting said press button to be depressed; and switch means mounted in the elongated switch hole of said casing and moved between a first position in which said gas lever is turned upwards to hold said gas flow rate control valve assembly in an open status for permitting fuel gas to continuously flow out of said fuel gas tank into said flame nozzle assembly, and a second position in which said gas lever is disengaged from said switch means and can be operated by said press button.

2. The hand gas torch of claim 1, wherein said fuel gas tank is transparent, comprising two longitudinal pairs of rails bilaterally disposed on the inside, and an ornamental display board fastened to said rails, said ornamental display board having a longitudinal fuel gas guide groove in the middle and an opening in said longitudinal fuel gas guide groove.

3. The hand gas torch of claim 2, wherein said ornamental display board is printed with a printing.

4. The hand gas torch of claim 1 further comprising foot means fastened to said fuel gas tank around said bottom cover.

5. The hand gas torch of claim 1, wherein said feed valve comprises a threaded valve block, a first rubber seal ring mounted around said threaded valve block, a valve rod mounted within said threaded valve block and having a head at a top side and a neck in the middle, a second rubber seal ring mounted around the neck of said valve rod, a cap fixedly fastened to said threaded valve block, and a spring mounted within said cap around the head of said valve rod, the spring of said feed valve imparting a downward pressure to said valve rod, causing it to close the passage of said feed valve.

6. The hand gas torch of claim 1, wherein said gas flow rate control valve assembly comprises a control valve mounted in the gas outlet of said fuel gas tank, an adjustment ring mounted around said control valve, and an adjustment lever connected to said adjustment ring and turned to control the flow rate of fuel gas passing through said control valve, said control valve comprising a stepped socket mounted in the gas outlet of said fuel gas tank, a first rubber seal ring mounted around said stepped socket within the gas outlet of said fuel gas tank, an absorptive dip tube mounted in said stepped socket and extended out of a bottom end of said stepped socket and dipped in liquid fuel gas in said fuel gas tank, a valve block fastened to said stepped socket on the inside by a screw joint and having a toothed head fastened to said adjustment ring, a hollow valve rod mounted inside the valve block of said control valve and partially projecting out of a top end of the valve block of said control valve and coupled to a front end of said gas lever, a spring mounted within the valve block of said control valve around the valve rod of said control valve, a cushion mounted around the valve rod of said control valve and supported on the spring of said control valve, a substantially T-shaped hollow cap mounted in a bottom end of the valve rod of said control valve, a hollow plug member plugged in a bottom end of the valve block of said control valve, a copper plate and a copper wire gauze filter mounted in a top end of said dip tube within said stepped socket, and a sponge mounted within said stepped socket and retained between said copper plate and said copper wire gauze filter.

7. The hand gas torch of claim 1, wherein a metal coil spring is mounted around said flexible tube of said fuel gas supply device, and adapted to close the circuit of said piezoelectric device when said press button is depressed.

8. The hand gas torch of claim 1, wherein a flame nozzle cap is connected to a lug at said casing by a chain and adapted for closing said flame nozzle.

9. The hand gas torch of claim 1, wherein said flame nozzle of said flame nozzle assembly comprises and a flame nozzle body mounted within said heat insulative inner tube, said flame nozzle body having an axial nozzle hole connected to said gas nozzle and a radial air vent adapted to guide outside air into said axial nozzle hole for mixing with fuel gas, a gear mounted within said axial nozzle hole and defining with said flame nozzle body a plurality of flow passages, a hollow cap mounted on said flame nozzle body to hold said gear in place, and a gasket mounted around said flame nozzle body and supported on said heat insulative inner tube.

* * * * *